US007553136B2

(12) United States Patent
Ku et al.

(10) Patent No.: US 7,553,136 B2
(45) Date of Patent: Jun. 30, 2009

(54) LOW PROFILE HEAT DISSIPATING FAN

(75) Inventors: Chin-Long Ku, Tu-Cheng (TW); Chin-Wen Yeh, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 563 days.

(21) Appl. No.: 11/165,944

(22) Filed: Jun. 24, 2005

(65) Prior Publication Data

US 2006/0045773 A1 Mar. 2, 2006

(30) Foreign Application Priority Data

Aug. 27, 2004 (CN) ..... 2004 1 0051297

(51) Int. Cl.
*F04B 35/04* (2006.01)
*H02K 21/24* (2006.01)

(52) U.S. Cl. ..... 417/423.7; 417/423.12; 310/156.32

(58) Field of Classification Search ..... 417/423.7, 417/423.12; 310/156.32–156.38
See application file for complete search history.

(56) References Cited

U.S. PATENT DOCUMENTS

| | | | | |
|---|---|---|---|---|
| 2,366,562 | A * | 1/1945 | Schug | 417/420 |
| 3,075,816 | A * | 1/1963 | Harris et al. | 384/420 |
| 4,788,464 | A | 11/1988 | Nishikawa et al. | |
| 4,922,162 | A * | 5/1990 | Shiraki et al. | 310/268 |
| 5,405,243 | A * | 4/1995 | Hurley et al. | 416/189 |
| 5,598,048 | A * | 1/1997 | Dunfield et al. | 310/90.5 |
| 6,488,486 | B1 * | 12/2002 | Debleser | 417/423.8 |

* cited by examiner

*Primary Examiner*—Devon C Kramer
*Assistant Examiner*—Philip Stimpert

(57) ABSTRACT

An electric fan includes a stationary assembly and a rotor (40) being rotatable with respect to the stationary assembly. The stationary assembly includes a support member (16) located at a center portion thereof, and a stator (20) mounted around the support member. The rotor includes a blade set (41) having a rotary shaft (412) extending from the blade set toward the stationary assembly and pivotably supported by the support member. A rail assembly consisting of a lower rail (18) and an upper rail (49) is attached to the stationary assembly and the blade set to movably support the rotor on the stationary assembly.

16 Claims, 5 Drawing Sheets

LOW PROFILE HEAT DISSIPATING FAN

TECHNICAL FIELD

The present invention relates generally to electrical fans, and more particularly to a heat dissipating fan having a low profile.

BACKGROUND

Heat dissipating fans are often used to cooperate with heat sinks to dissipating heat from heat source such as CPUs (Center Processing Units) in computer systems. In such a heat dissipating fan, a stator has stator coils to generate alternating electromagnetic fields when charged with alternating current, and a rotor comprises a blade set and a permanent magnet carried by the blade set. The permanent magnetic field of the permanent magnet interacts with the electromagnetic fields of the stator coils to drive the blade set to rotate, thereby generating airflow toward components to be cooled. To rotatably support the blade set, the heat dissipating fan usually comprises a bearing, and the rotor comprises a rotary shaft extending from the blade set into the bearing.

For the computer systems, especially for portable computer systems such as, for example, notebook computers, there exists a trend toward miniaturized size in the relevant industry. In particular, the portable computer systems are desired to have a low profile, i.e., a small thickness, to make them more appealing to customers. Therefore, it may be desirable to provide a heat dissipating fan having a reduced axial size.

As the axial size of the heat dissipating fan is reduced, the axial height of the bearing is reduced accordingly. However, as the height of the bearing is reduced, the supporting area between the bearing and the rotary shaft is reduced accordingly. This may cause vibration of the blade set during rotation thereof and unwanted noise thereby. Therefore, a heretofore unaddressed need exists in the industry to address the aforementioned deficiencies and inadequacies.

SUMMARY OF THE INVENTION

An embodiment of the present invention provides a fan having a low profile. The fan includes a stationary assembly and a rotor being rotatable with respect to the stationary assembly. The stationary assembly includes a support member located at a center portion thereof, and a stator mounted around the support member. The rotor includes a blade set having a rotary shaft extending from the blade set toward the stationary assembly and rotatably supported by the support member. A rail assembly is attached to the stationary assembly and the blade set to movably support the rotor on the stationary assembly.

Other systems, methods, features and advantages of the present invention will be drawn from the following detailed description of the preferred embodiments of the present invention with attached drawings, in which:

DESCRIPTION OF PREFERRED EMBODIMENTS

Figure 1:
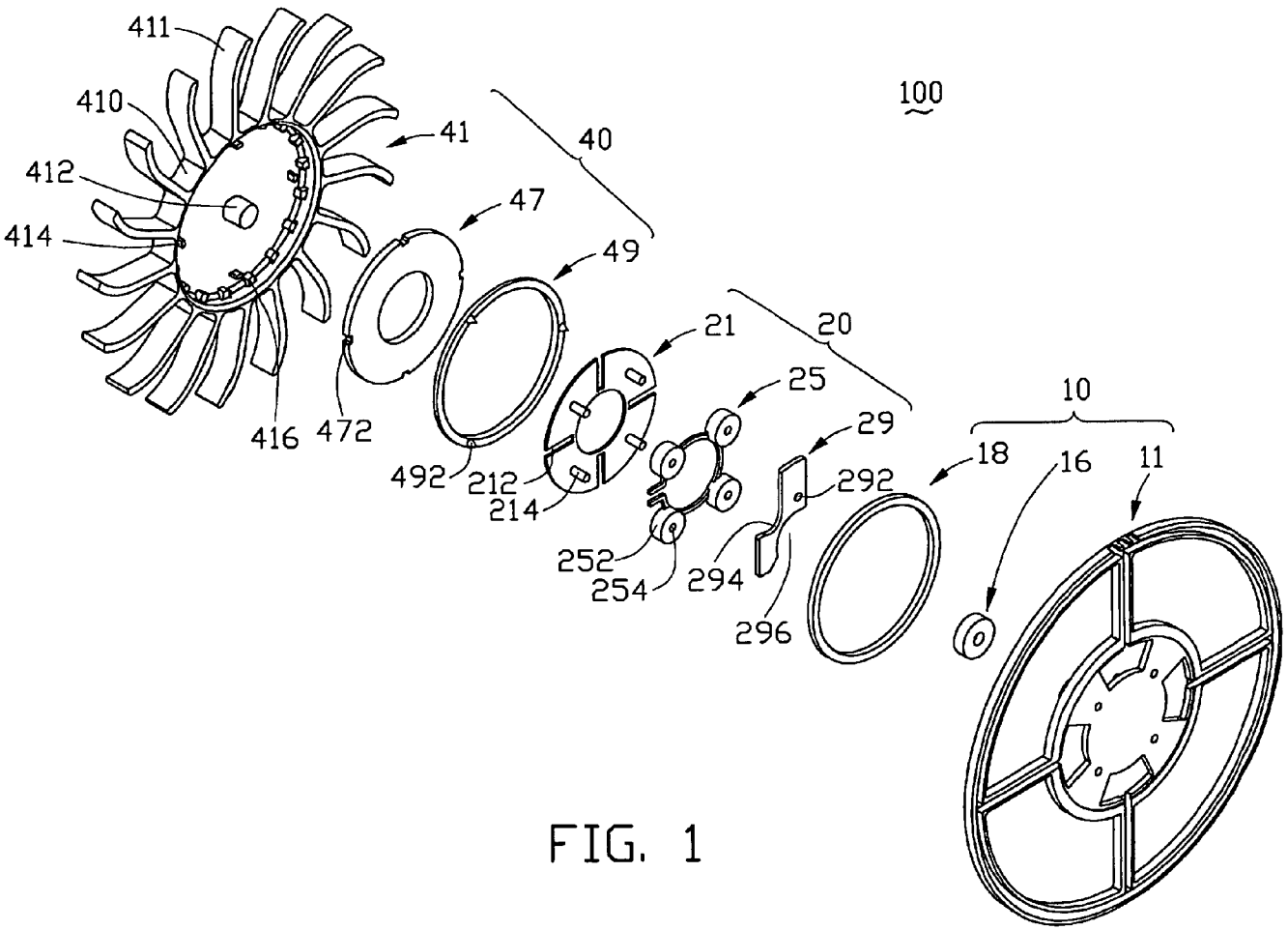
FIG. 1 is an isometric, exploded view of a heat dissipating fan according to a preferred embodiment of the present invention.
Figure 2:
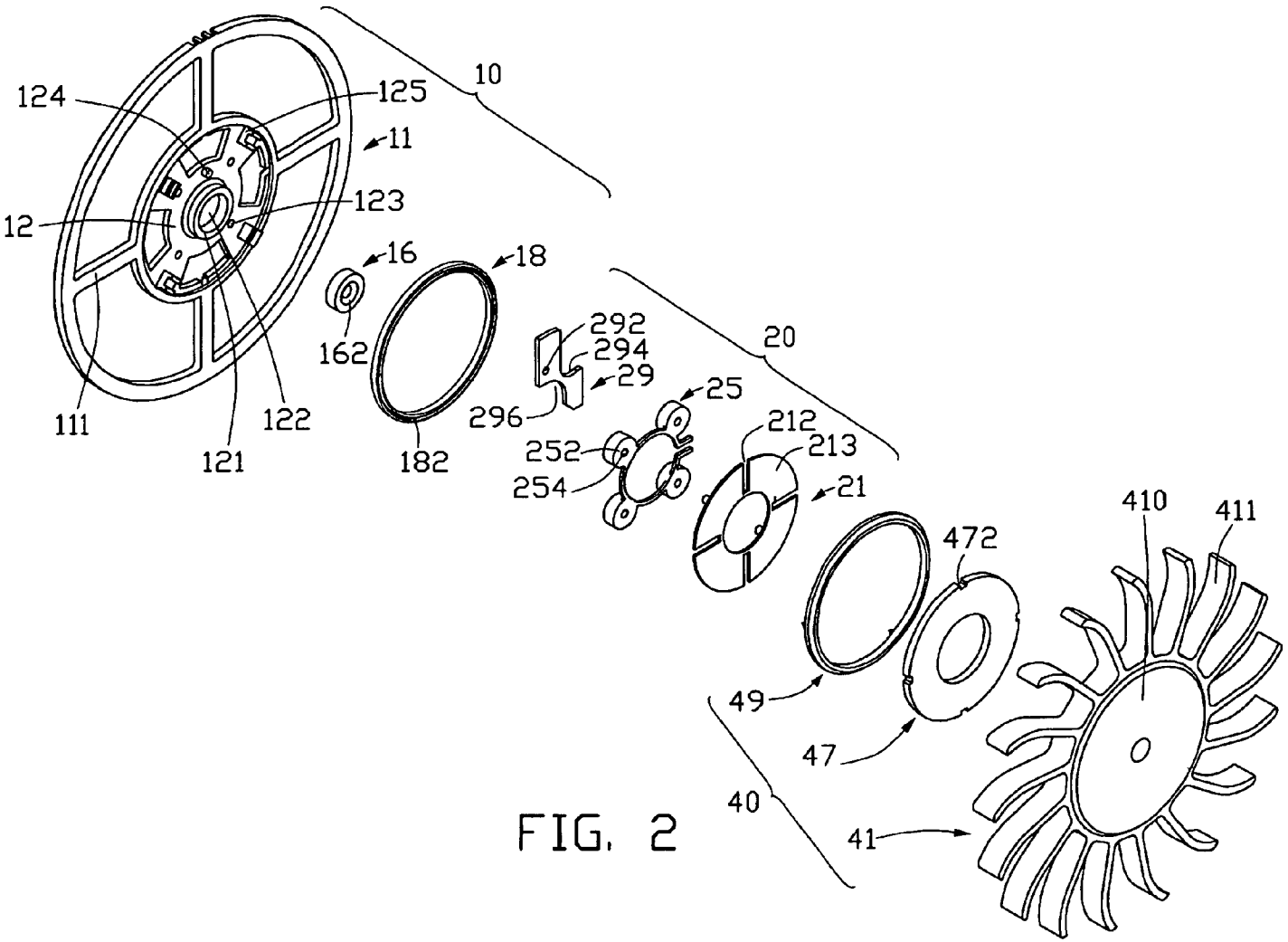
FIG. 2 is similar to FIG. 1, but viewed from another aspect.

Referring to FIGS. 1 and 2, an electric fan 100 in accordance with a preferred embodiment of the present invention comprises a fan base 10, a stator 20 positioned on the fan base 10, and a rotor surrounding and being rotatable with respect to the stator 20.

The fan base 10 comprises a base plate 11, a support member 16 located on the base plate 11, and an annular lower rail 18 positioned on the base plate 11 and surrounding the support member 16.

The base plate 11 comprises a round outer periphery, a center portion 12 and four ribs 111 connecting the center portion 12 with the outer periphery. A center tube 121 extends perpendicularly from the center portion 12. The center tube 121 has a center hole 122, for receiving the support member 16 therein to thereby mount the support member 16 to the center portion 12. Alternatively, the support member 16 may be integrally formed with the base plate 12.

A plurality of generally U-shaped mounting blocks 125 is circumferentially formed on a peripheral portion of the center portion 12. The mounting blocks 125 are used for positioning the lower rail 18 on the base plate 11. Alternatively, the lower rail 18 may be joined to the base plate 11 by means of molding or adhesive. Four positioning holes 123 and a mounting pin 124 are formed around the center tube 121. The positioning holes 123 and the mounting pin 124 are used for positioning the stator 20 on the base plate 11, which will be detailed hereinafter.

The support member 16 defines an inner hole therein. A diameter of the inner hole at a top portion of the support member 16 gradually increases in a bottom-to-top direction, thereby forming an annular tapered support surface 162 at the top portion of the support member 16. In other words, the inner hole has a flared opening.

The rail 18 defines an annular guiding slot 182 at a top side thereof. The rail 18 is used for rotatably supporting the rotor 40, which will be detailed hereinafter.

The stator 20 comprises a pole plate 21, a winding 25 for being attached to the pole plate 21, and a printed circuit board 29 having electrical circuit for driving and controlling the electric fan 100.

Four radically extending slits 212 are defined in the pole plate 21, dividing the circular pole plate 21 into four identical pole arms 213. Four positioning posts 214 extend perpendicularly from the pole arms 213 respectively, for extending into the positioning holes 123 of the base plate 11 respectively.

The winding 25 comprises four coils 252 wound around the positioning posts 214 respectively. In the preferred embodiment, the coils 252 are formed prior to attachment to the pole plate 21. Each coil 252 defines a through hole 254 for receiving a corresponding positioning post 214 therein.

Figure 4:
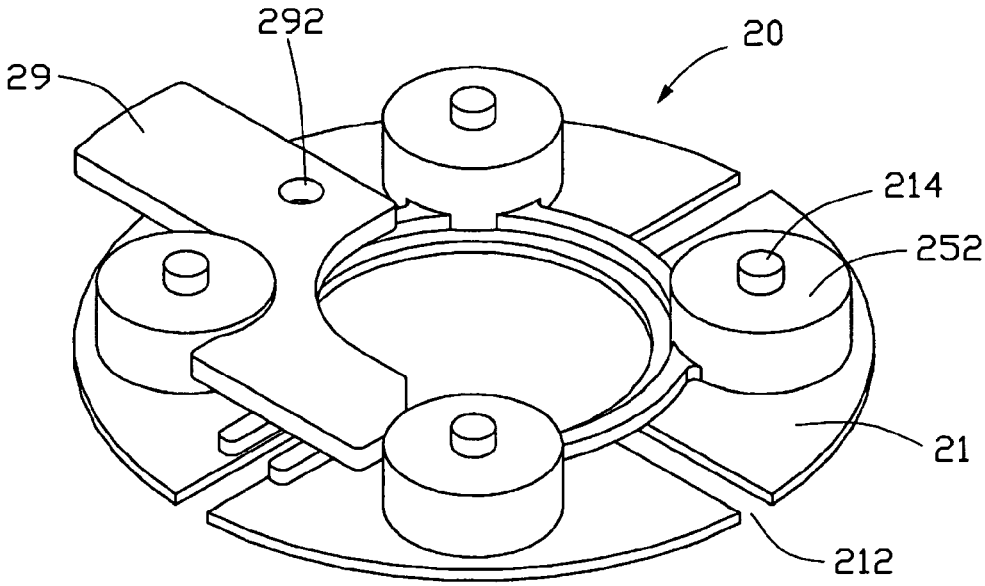
FIG. 4 is a partly assembled view showing the stator of the heat dissipating fan.

The electrical circuit of the printed circuit board 29 electrically connects with the wire of the winding 25. A mounting hole 292 is defined in the printed circuit board 29, for receiving the mounting pin 124 of the base plate 11 therein to thereby positioning the printed circuit board 29. A first cutout 294 is defined at one side of the printed circuit board 29, for compliance with the outer periphery of one of the coils 252 (FIG. 4). A second cutout 296 is defined at an opposite side of the printed circuit board 29, for compliance with the center tube 121 of the base plate 11.

The rotor 40 comprises a blade set 41, a permanent magnet 47 for being attached to the blade set 41, and an annular upper rail 49.

The blade set 41 comprises a hub 410 having a top wall and a peripheral sidewall extending downwardly from the top wall. A plurality of fan blades 411 is so formed that each fan blade 411 extends outwardly from the sidewall of the hub 410. Each fan blade 411 has a generally arced configuration. A rotary shaft 412 extends perpendicularly from an inside of the top wall of the hub 410. A free end of the rotary shaft 412 is tapered (See also FIG. 7) to correspond to the support surface 162 of the support member 16.

The permanent magnet 47 is in a form of ring plate. The permanent magnet 47 is attached to the inside of the top wall of the hub 410 (See also FIG. 5). In this preferred embodiment, four positioning slots 472 are defined in an outer periphery of the permanent magnet 47, and four protrusions 414 are formed on an inside of the top plate of the hub 410. The permanent magnet 47 is attached to the hub 410 by engagement of the protrusions 414 into respective positioning slots 472. Alternatively, the permanent magnet 47 may be attached to the hub 410 by other means, such as, for example, by adhesive.

The upper rail 49 forms three support tips 492 on a bottom side thereof, for being movably received in the guiding slot 182 of the lower rail 18. The supporting tips 492 are tapered. The upper rail 49 is attached to the inside of the top wall of the hub 410, surrounding the permanent magnet 47. In this preferred embodiment, the hub 410 forms a plurality of positioning blocks 416 at a junction of the top wall and the sidewall thereof. The positioning blocks 416 engage interferentially with an outer periphery of the upper rail 49, thereby positioning the upper rail 49 to the hub 410. Alternatively, the upper rail 49 may be attached to the hub 410 by other means, such as, for example, by adhesive.

Assembly of the heat dissipating fan will be described hereinafter with reference to FIGS. 3 through 7.

Figure 3:
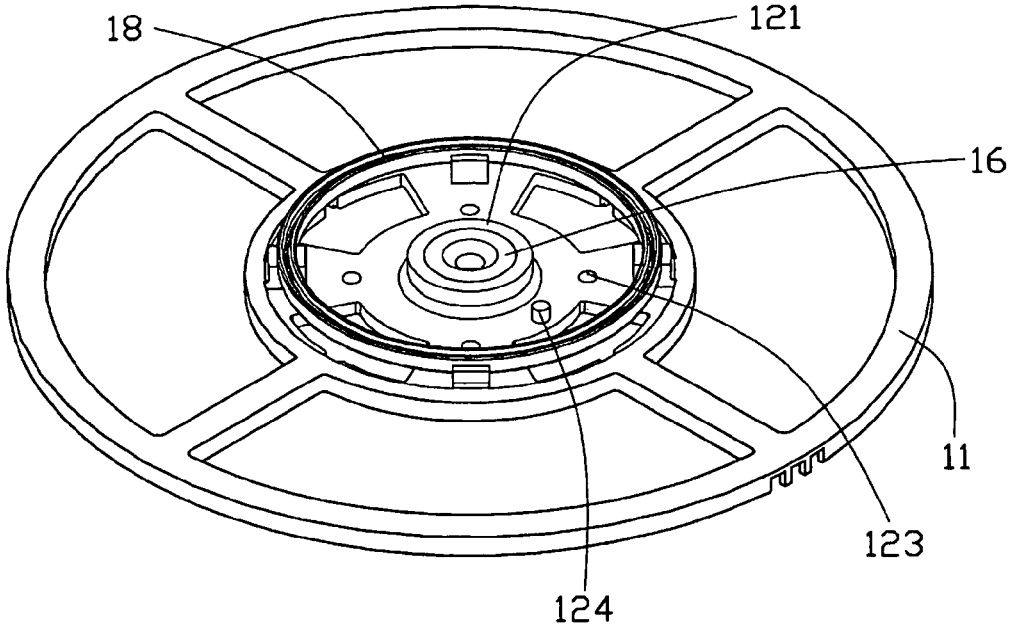
FIG. 3 is a partly assembled view showing the fan base of the heat dissipating fan.

Referring to FIG. 3, in assembly of the fan base 10, the support member 16 is received in the center tube 121 of the base plate 11. The lower rail 18 is received in the U-shaped blocks 125 and thereby mounted on the base plate 11.

Referring to FIG. 4, in assembly of the stator 20, the coils 252 of the winding 25 are attached to the pole plate 21. The positioning posts 214 extend through the through holes 254 of the coils 252. End portions of the positioning posts 214 extend beyond respective coils 252. The printed circuit board 29 is temporarily positioned to the combined winding 25 and the pole plate 21. One of the coils 252 engages with the printed circuit board 29 at the first cutout 294.

The preassembled stator 20 is then assembled to the fan base 10. The positioning posts 214 extend into the positioning holes 123 of the base plate 11, thereby positioning the pole plate 21 and the winding 25 on the fan base 10. The mounting pin 124 of the base plate 11 extends into the mounting hole 292 of the printed circuit board 29, and the center tube 121 engages with the printed circuit board 20 at the second cutout 296, thereby cooperatively positioning the printed circuit board 29 between the pole plate 21 and the base plate 11. The fan base 10 and the stator 20 are fixed to each other to form a stationary assembly with respect to which the rotor 40 rotates. In the stationary assembly, the annular lower rail 18 surrounds the stator 20.

Figure 5:
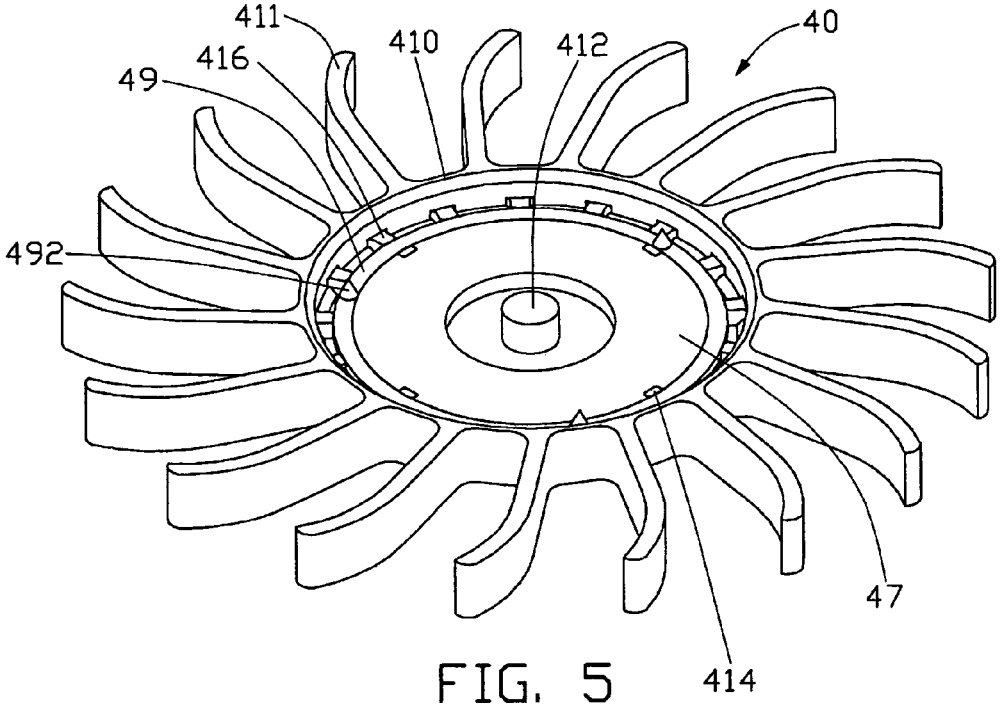
FIG. 5 is a partly assembled view showing the rotor of the heat dissipating fan.

Referring to FIG. 5, in assembly of the rotor 40, the permanent magnet 47 is attached to the inside of the top wall of the hub 410 and positioned by the protrusions 414 fitting in the positioning slots 472. The upper rail 49 is attached to the inside of the top wall of the hub 410 and positioned by the positioning blocks 416 interferentially engaging with the outer periphery of the upper rail 49, in which an inner periphery of the upper rail 49 surrounds the permanent magnet 47.

Figure 6:
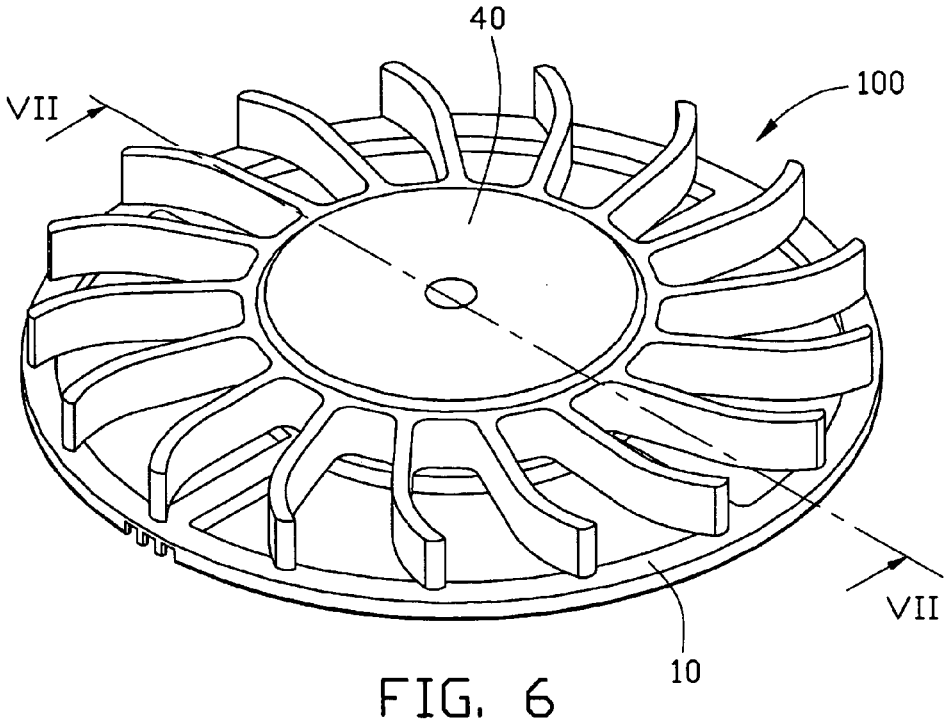
FIG. 6 is a fully assembled view of the heat dissipating fan.
Figure 7:
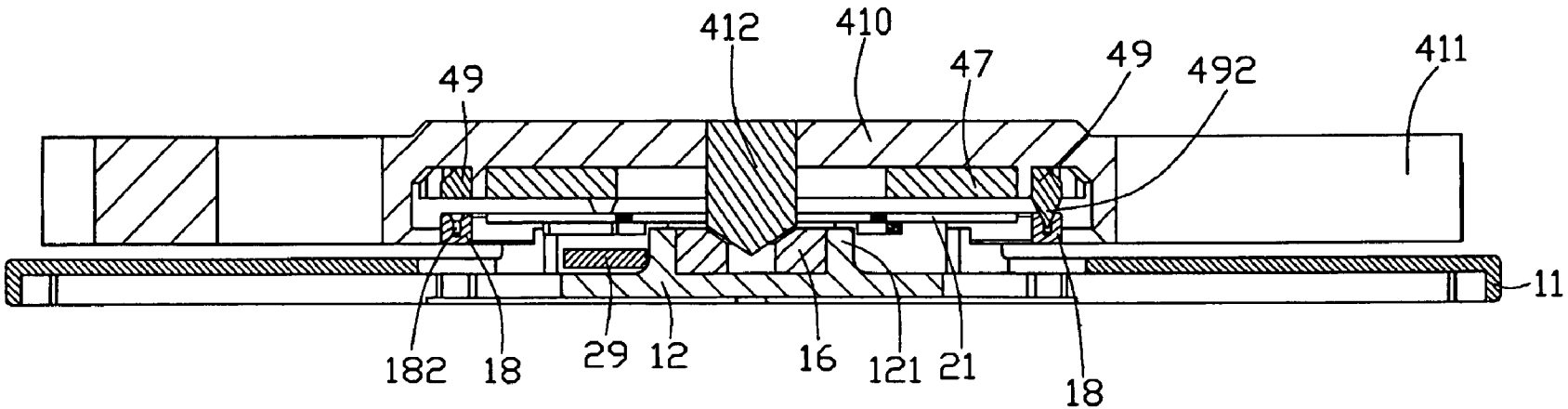
FIG. 7 is a cross sectional view of the heat dissipating fan, taken along line VII-VII of FIG. 6.

Referring to FIGS. 6 and 7, the rotor 40 is attached to the stationary assembly comprising the fan base 10 and the stator 20. The support member 16 engages with the tapered end of rotary shaft 412, thereby rotatably supporting the rotor 40. The guiding slot 182 of the lower rail 18 receives the support tips 492 of the upper rail 49, thereby movably supporting the rotor 40. The guiding slot 182 defines a rotating path of the upper rail 49 attached with the rotor 40 and therefore defines a rotating path of the rotor 40. This can improve the rotation stability of the rotor 40. The permanent magnet 47 and the pole plate 21 cooperatively define therebetween an axial magnetic flux gap. Since the permanent magnet 47 is not attached to the sidewall of the hub 410, the hub 410 can have a reduced axial size. This reduces the overall axial size of the heat dissipating fan 100.

In the above-mentioned heat dissipating fan, a rail assembly, i.e., the lower rail 18 and the upper rail 49, are respectively attached to the stationary assembly, specifically the fan base 10 in the preferred embodiment, and the rotor 40 to movably support the rotor 40. The lower rail 18 defines the guiding slot 182, and the upper rail 49 forms support tips 492 received in the guiding slot 182. In alternative embodiments, balls may be disposed between the lower and upper rails 18, 49 for such relative motion. In addition, the number of the pole arms 213 may be modified according to actual needs.

It is understood that the invention may be embodied in other forms without departing from the spirit thereof. The above-described examples and embodiments are to be considered in all respects as illustrative and not restrictive, and the invention is not to be limited to the details given above.

We claim:

1. An electric fan comprising:

a fan base having a base plate, an annular first rail attached to the base plate;

a stator mounted on the base plate, the stator comprising a pole member, a winding and a printed circuit board electrically connected with wires of the winding; and a rotor comprising a hub with a plurality of fan blades formed on the hub, the hub comprising a top wall and a peripheral sidewall extending from the top wall, a permanent magnet attached to an inside of the top wall of the hub and cooperating with the pole member to define therebetween an axial magnetic flux gap, and an annular second rail attached to the hub, the second rail axially facing to the first rail and movably cooperating with the first rail to define a rotation path of the rotor with respect to the stator;

wherein the pole member is in a form of a unitary plate, comprising a plurality of pole arms and a plurality of positioning posts extending perpendicularly from the pole arms respectively, the winding comprises a plurality of coils respectively wound around the positioning posts, the base plate defines a plurality of positioning holes therein, and the positioning posts of the pole member extend through the coils of the winding and engage into the positioning holes to position the stator on the base plate.

2. The electric fan of claim 1, wherein the rotor comprises a rotary shaft extending from the top wall toward the fan base, and the fan base comprises a support member pivotably supporting the rotary shaft.

3. The electric fan of claim 2, wherein the support member defines an inner hole therein, a diameter of the inner hole at a top portion of the support member gradually increases in a bottom-to-top direction thereof so as to form an annular tapered support surface at the top portion of the support member, and the rotary shaft comprises a tapered end pivotably engaging with the support surface.

4. The electric fan of claim 2, wherein the base plate comprises a center tube receiving the support member therein.

5. The electric fan of claim 4, wherein the printed circuit board defines a cutout, for compliance with the center tube of the base plate, and the center tube engages with the printed circuit board at the cutout.

6. The electric fan of claim 1, wherein the hub forms a plurality of protrusions, and the permanent magnet defines a plurality of positioning slots engagingly receiving the protrusions to position the permanent magnet to the hub.

7. The electric fan of claim 1, wherein the printed circuit board defines a cutout at one side thereof, for compliance with the outer periphery of one of the coils, and the one of the coils engages with the printed circuit board at the cutout.

8. The electric fan of claim 1, wherein the annular first rail is disposed around the stator and the annular second rail is disposed around the permanent magnet.

9. An electric fan comprising:

a stationary assembly having a support member located at a center portion thereof, and a stator mounted around the support member;

a rotor comprising a blade set having a rotary shaft extending from the blade set toward the stationary assembly and pivotably supported by the support member; and a rail assembly attached to the stationary assembly and the blade set to movably support the rotor on the stationary assembly;

wherein the stationary assembly comprises a fan base supporting the support member and the stator, and the blade set comprises a hub with a plurality of fan blades formed on the hub;

wherein the rail assembly comprises an annular first rail mounted to the fan base and surrounding an outer periphery of the stator, and an annular second rail attached to the hub to movably cooperate with the first rail;

wherein the hub comprises a top wall, a peripheral sidewall extending from the top wall, and a plurality of positioning blocks formed at a junction of the top wall and the peripheral sidewall, the positioning blocks surrounding and interferentially engaging with an outer periphery of the second rail; and wherein the stator comprises a plurality of pole arms formed in a unitary plate, a plurality of positioning posts extending from the pole arms respectively, and a plurality of coils respectively wound around the positioning posts, the fan base defines a plurality of positioning holes therein, the positioning posts extend through the coils and engage into the positioning holes to position the stator on the fan base.

10. The electric fan of claim 9, wherein one of the first and second rails forms a guiding slot to define a path of relative movement between the first and second rails.

11. The electric fan of claim 9, wherein the fan base comprises a plurality of U-shaped mounting blocks circumferentially formed around a center portion thereof to engagingly receive the first rail therein.

12. The electric fan of claim 9, wherein the support member defines an inner hole therein, a diameter of the inner hole at a top portion of the support member gradually increases in a bottom-to-top direction thereof so as to form an annular tapered support surface at the top portion of the support member, and the rotary shaft comprises a tapered end pivotably engaging with the support surface.

13. An electric fan comprising:

a stationary assembly, comprising:

a base, a stator mounted to the base, an annular first rail mounted to the base and surrounding the stator; and a rotor rotatably mounted to the stationary assembly, comprising:

a hub having a plurality of fan blades extending outwardly from a periphery thereof, a magnet attached to the hub and spaced from the stator a distance along an axial direction of the electric fan from the hub to the base, and an annular second rail mounted to the hub, the annular second rail surrounding the magnet and rotatably engaging with the first rail;

wherein the stator comprises a plurality of pole arms formed in a unitary plate, a plurality of positioning posts extending from the pole arms respectively, and a plurality of coils respectively wound around the positioning posts, the base defines a plurality of positioning holes therein, the positioning posts extend through the coils and engage into the positioning holes to position the stator on the base.

14. The electric fan of claim 13, wherein the first rail defines a guiding slot in a top surface thereof and the second rail has a plurality of support tips engaging in the guiding slot.

15. The electric fan of claim 14, wherein the base further comprises a support at a center thereof, and the hub further has a rotary shaft at a center thereof, the rotary shaft having a tapered end engaging with the support.

16. The electric fan of claim 13, wherein the base further comprises a support at a center thereof, and the hub further has a rotary shaft at a center thereof, the rotary shaft having a tapered end engaging with the support.

* * * * *